US006902094B2

(12) United States Patent
Mochizuki et al.

(10) Patent No.: US 6,902,094 B2
(45) Date of Patent: Jun. 7, 2005

(54) STAPLER APPARATUS

(75) Inventors: Naoto Mochizuki, Yamanashi Prefecture (JP); Yosuke Sajiki, Yamanashi Prefecture (JP)

(73) Assignees: ACCO Brands, Inc., Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/450,070

(22) PCT Filed: Dec. 21, 2001

(86) PCT No.: PCT/IB01/02624

§ 371 (c)(1),
(2), (4) Date: Jun. 9, 2003

(87) PCT Pub. No.: WO02/053328

PCT Pub. Date: Jul. 11, 2002

(65) Prior Publication Data

US 2004/0046000 A1 Mar. 11, 2004

(30) Foreign Application Priority Data

Dec. 28, 2000 (JP) ..... 2000-402784

(51) Int. Cl.[7] ..... B25C 5/15
(52) U.S. Cl. ..... 227/155; 227/131; 227/138
(58) Field of Search ..... 227/131, 155, 227/138, 120, 136

(56) References Cited

U.S. PATENT DOCUMENTS

| | | | | |
|---|---|---|---|---|
| 2,652,942 A | | 9/1953 | Munchy | |
| 3,009,156 A | * | 11/1961 | Lerner | 227/88 |
| 4,588,121 A | * | 5/1986 | Olesen | 227/120 |
| 4,770,334 A | * | 9/1988 | Hoshi et al. | 227/85 |
| 5,230,457 A | * | 7/1993 | Hiroi et al. | 227/2 |
| 5,273,199 A | | 12/1993 | Logtens | |
| 5,474,222 A | * | 12/1995 | Kanai et al. | 227/131 |
| 6,039,230 A | * | 3/2000 | Yagi et al. | 227/120 |
| 6,050,471 A | | 4/2000 | Yagi | |
| 6,108,896 A | | 8/2000 | Gignac et al. | |
| 6,371,351 B1 | | 4/2002 | Magnusson | |
| 2004/0118895 A1 | | 6/2004 | Mochizuki et al. | |

FOREIGN PATENT DOCUMENTS

WO WO 02/18112 A2 7/2002

* cited by examiner

*Primary Examiner*—Scott A. Smith
(74) *Attorney, Agent, or Firm*—Michael Best & Friedrich LLP

(57) ABSTRACT

A stapler apparatus is equipped with linked staples and includes a staple feed member configured for feeding staples to a driving position, a staple driver operable to drive the staples from the driving position into a stack of sheets, and an anvil unit operable to engage and clamp the stack of sheets to be stapled. The staple feed member is powered by movement of the anvil unit.

11 Claims, 7 Drawing Sheets

STAPLER APPARATUS

BACKGROUND OF THE INVENTION

The present invention relates to a stapler apparatus which binds media (a sheet bundle), such as a plurality of documents printed with a copying machine, a printer, or a composite of machines thereof, etc., with staples.

Conventionally, this type of stapler has a staple feed pawl which successively advances and feeds staples composed of a belt roll of staples or stacked sheets of sheet shaped staples loaded in a cartridge to a driving position, arranges a driver means for driving staples into the bundle of sheets on the side provided with the staple feed pawl, arranged a clincher means for appropriately bending the ends of the staple driven and pierced through the bundle of sheets with the driver means on the opposite side with the staple band as a boundary, and stapled the bundle of sheets interposed between this driver means and the clincher means by swinging in the direction for being made adjacent to each other or separated from each other.

SUMMARY OF THE INVENTION

However, the advance feeding of staples at this time is executed by linking the charging operation of the staple feed pawl with the operation of punching staples into the bundle of sheets with the driver means and the advance feeding operation of the staple feed pawl is not executed according to the reciprocating movement of the driver means.

However, a method for advancing the staple feed pawl through the reciprocal movement of the driver means, the driver means places the staple feed pawl in a charged state when drawing a staple formed into a U-shape by the former means and drives the staple into a binding media but does not act to push the staple band to the driving position and is easily offset. Formed staples are offset by any shock so the driver means is unable to support the crown portion of the staple so staples are received in such a state and when driving the staples into a binding media, the drive of the driver means on the staple is offset resulting in not being able to complete drive the staple into the binding media which is a cause of binding problems.

An object of the present invention in view of the aforementioned problem, is to check the occurrence of trouble of binding problems by making at least no staple position offsets, and to drive staples at the driving position with the staple feed pawl advancing to prevent the occurrence of mis-positioning of staples when driving staples when driving staples into a binding media using the driver means.

In one embodiment, the invention provides a stapler apparatus comprising staples linked in series by adhesive, a feed means that feeds these staples to the staple driving position and urges these staples to the staple driving position and a staple driving means to drive the staples at the staple driving position into a binding media. An actuating means actuates the staple feeding means to urge the next staple linked to staple driving position before the aforementioned staple driving means touches the aforementioned staple with the driving action.

This structure can urge the staple to drive into the binding media with the driver means without offsetting from the driving position by the staple feeding means and stabilizes the positional relationship of the driver means and staple to securely staple and hold down binding problems.

In one aspect of the invention, the stapler apparatus moves the aforementioned actuating means thereby charging the aforementioned staple feeding means and releasing that charge.

According to this invention, to make it possible to charge and to release a charge by the reciprocal movement of the staple feeding means, the time that the staple feeding means is charged can be released without waiting for the recovery after completing the stapling process, compared to conventionally not being able to continue until the recovery after completing the stapling process so the load applied to the charging of the staple feeding means can be performed in a timing that does not mal-affect the stapling action.

Also, it is possible to actuate by the staple feeding means staple feeding ability even at the recovery to thoroughly ensure the feeding amount of the staple feed.

In another aspect of the invention, the actuating means retracts from the actuating position of the aforementioned staple feeding means.

This invention does not require excessive staple feeding if the staple feeding means staple feeding ability is enough.

In yet another aspect of the invention, the actuating means is disposed with a nipping member that nips the binding media.

According to this invention, specifically an actuating means is disposed on a nipping member and by using the reciprocal movement thereof, there is no need to dispose a separate drive mechanism.

In a further aspect of the invention, the staple feeding means includes a leaf spring that swingingly urges in one direction and a feeding pawl to feed staples urged by the leaf spring.

According to this invention, it is possible to stop and release staples by the elastic deformation of a single leaf spring and requires no special mechanism.

Below, an embodiment of the stapler apparatus according to the present invention will be described in accordance with the figures.

Figure 1:
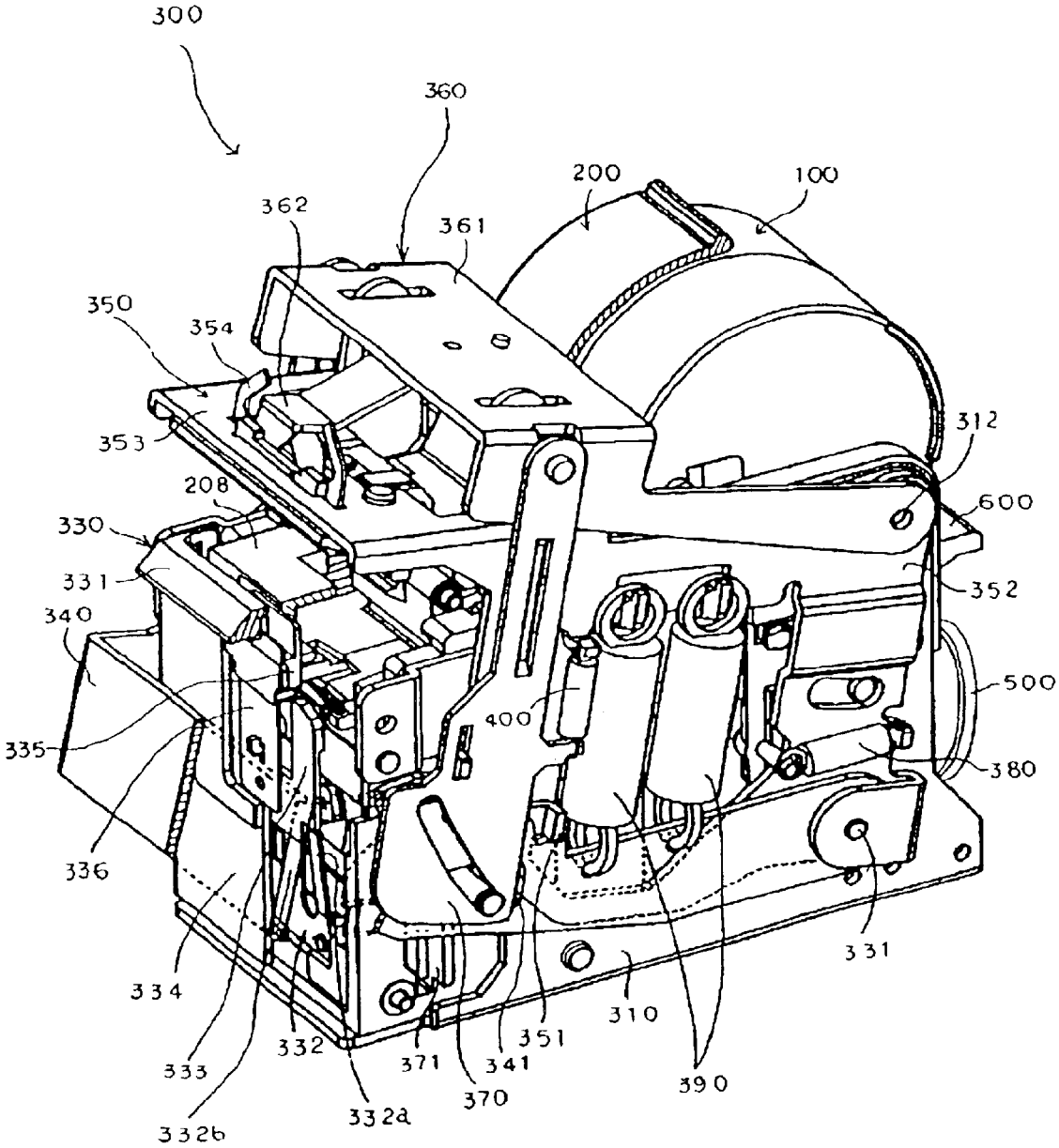
FIG. 1 is an external perspective view of a sectional portion comprising the stapler apparatus according to the invention.

| Description Of The Reference Numerals | |
|---|---|
| 100 | Staple cartridge |
| 101 | Staple band material (staples) |

-continued

| Description Of The Reference Numerals | |
|---|---|
| 106 | Leading edge stopper |
| 107 | Feed pawl advancing protrusion |
| 200 | Cartridge holder |
| 202 | Staple feed means |
| 202a | Feed pawl member |
| 202a2 | Feed pawl |
| 202a4 | Cartridge advancing arm |
| 202b | Feed pawl spring |
| 300 | Stapler unit |
| 332 | Driver (staple driving means) |
| 333 | Former (staple driving means) |
| 355 | Feed pawl charging means (actuating means) |

DETAILED DESCRIPTION

FIG. 1 is an external perspective view showing a section of part of the entire stapler apparatus, mainly comprising the staple cartridge 100, the cartridge holder 200 and the stapler unit 300.

Firstly, to describe the apparatus according to the sequence of its assembly, the stapler unit 300 comprises the unit frame 310, the electric drive unit, not shown in the figures, the staple head unit 330, the actuating lever 340, the anvil unit 350, the clincher unit 360, the interlock lever 370, the anvil spring 380, the paper thickness absorbing spring 390, the clincher spring 400 and the manual drive plate 500.

Figure 2:
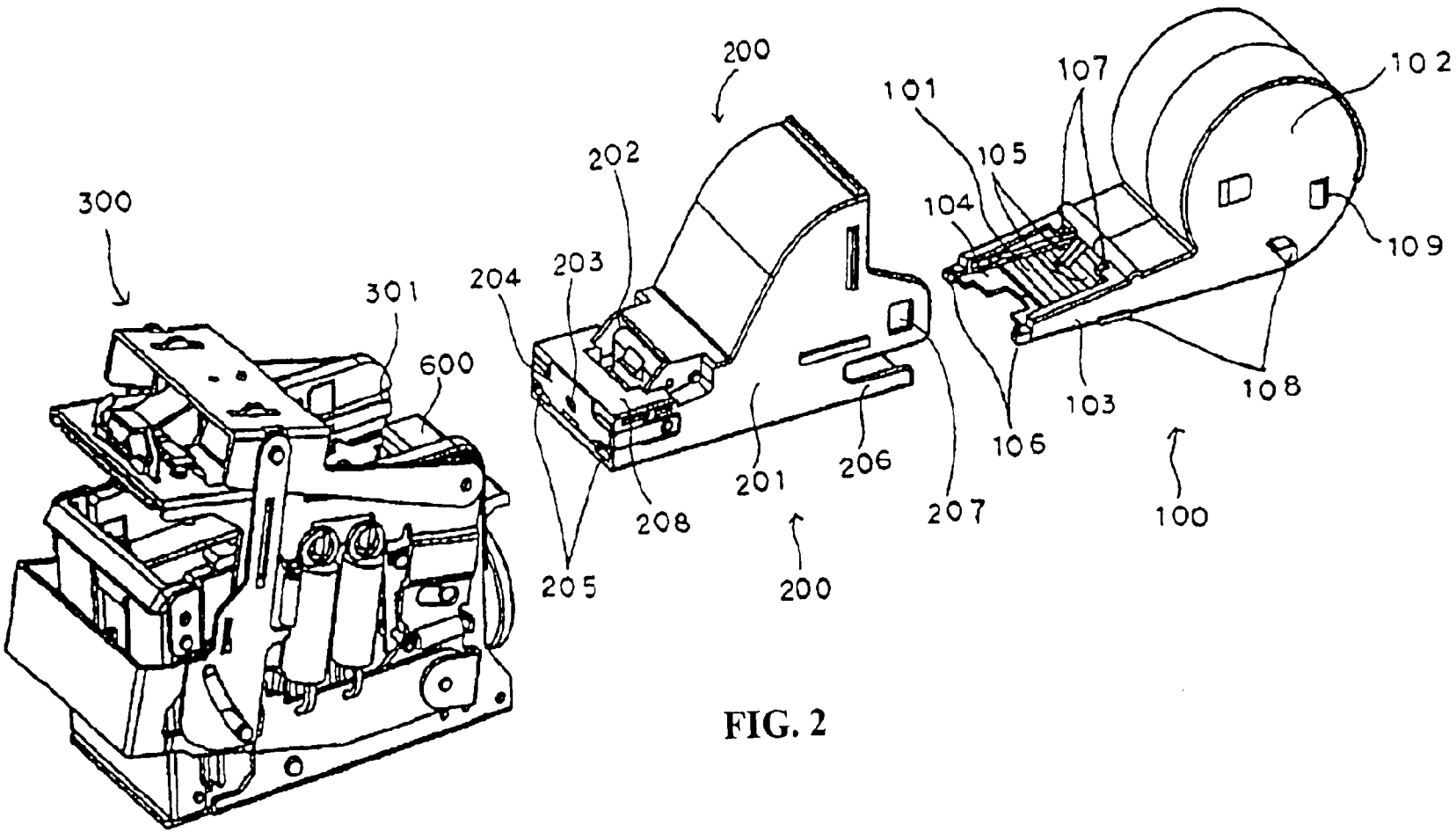
FIG. 2 is an external perspective view of the disassembled units of the stapler apparatus according to the instant invention.

The unit frame 310 is sheet metal pressed formed into a sectional U-shape comprising sides established left, right and a bottom. It internally holds the electric drive unit, thereabove the holder guide 301, which is shown in FIG. 2 and the staple head unit 330 in the leading edge and properly supports other units on the outside side walls thereof.

Note that the electric drive unit, which is not shown in the figures, is composed of a direct current motor that is the stapler drive source, the gear train that decelerates the rotation of the motor to a determined rotating speed and the transmission cams that are decelerated to the determined speed and rotate. Each transmission cams drive the staple head unit 330 and the anvil unit 350 via the actuating lever 340 and the interlock lever 370 and by driving the clincher unit 360 it controls the series of operations of the stapler.

The staple head unit 330 comprises the sheet loading table 331, the driver 332, the former 333, the sheath 334 and the bending block 335.

Furthermore, the staple head unit 330 starts the upward direction displacement of the driver 332 pressed formed with a leaf spring material by the driver drive cam pin disposed on the last level of the electric drive unit.

Displacement of the driver 332 abuts the former abutting piece 332*a* on the driver 332 against the former 333. The driver 332 and former 333 follow a stepped surface, not shown in the figures, formed on the sheath 334 upward to a position where that abutment is released.

The former 333 bends into a U-shape staples drawn to the staple bending position of the bending block bending block 335 and holds to guide U-shaped staples on the sides of the former 333 thereof to enable driving. Note that the position where the staple is bent by the former 333 corresponds to the staple driving position below.

In this state, the driver 332 released from abutting the former 333 by the protrusion, not shown in the figures, formed at the sheath 334 is displaced further upward leaving the former 333 in that position.

By displacing upward, the staple driving unit 332*b* positioned at the leading edge of the driver 332 displaces the bending block 335 to the front from the region of movement of the driver 332 and retracts.

The staple driving unit 332*b* of the driver 332 displaced further upward separates from the adhesive staples that have been bent and are adhering to the next staple by adhesive tape. Formed and separated staples are driven by the binding media.

Next, the actuating lever 340 has arms extending left and right along the side surfaces of the anvil unit 350. While nipping in the unit frame 310, they are supported by the interlocking pivot shaft 331 disposed on the anvil unit 350 sides.

In addition, the paper thickness absorbing springs 390 are stretched between the anvil unit 350 in a central location on the left and right arms of the actuating lever 340. These springs 390 constantly urge in the counterclockwise direction around the interlocking pivot shaft 331 to contact with the stopper 351 formed on the anvil unit 350.

The notch 341 comprising an edge to abut with the anvil drive lever, which is not shown in the figures, driven to displacement by the electric drive unit is formed on the leading edge of the arm positioned on the other edge of the left and right arms. The anvil drive lever swings it clockwise around the interlocking pivot shaft 331 which is pressed and urged downward.

The anvil unit 350, the anvil rocking pivot 352 on one side thereof rockingly supported on the pivot shaft 312 on the unit frame 310, is constantly rotatingly urged in the clockwise direction by the anvil spring 380 around the pivot shaft 312.

The anvil head 353 on the other side follows the rocking of the actuating lever 340 and rocks counter-clockwise resisting the urging force of the anvil spring 380 to nip and support the binding media at a position that corresponds to the thickness thereof.

Note that after the anvil unit 350 nips and supports the binding media by the paper thickness absorbing springs 390, the actuating lever 340 continues acting alone in resistance to the resilient force of the paper thickness absorbing springs 390 because the anvil unit 350 is locked in that nipping position.

To the anvil head 353 that nips the binding media on the anvil unit 350, the clincher unit 360 that has the left and right paired clinchers 354 for bending the leading edges of staples that have penetrated the binding media driven from below the binding media, is disposed to follow.

The clincher unit 360 comprises the clincher lever 361 and is supported by the pivot shaft 312 on the unit frame 310 which is also the pivot for the anvil rocking pivot 352 on the anvil unit 350. To the leading edge of the clincher unit 360 is mounted the clincher head 362 that bends staples that have been driven and rocks the clincher 354 mounted to the anvil head 353 on the anvil unit 350.

The clincher head 362 is press formed using a steel plate for a spring with a thickness of 1.5 mm while the clincher lever 361 is formed using a plated steel plate of a thickness of 2.0 mm, to absorb the difference in pressing stroke of the clincher 354.

Next, the interlock lever 370 follows the rocking of the anvil unit 350 via the clincher spring 400 to rock the clincher unit 360 and is disposed to continue rotating with the rocking of the clincher drive lever, not shown in the drawings, while the anvil unit 350 nips and stops the binding media and after the anvil unit 350 stops at the nipping position that corresponds to the thickness of the binding media, it continues rotating to bend the staples.

The manual drive plate 500 is for resetting stapling defects by manually operating the stapler when a staple is not properly driven by the binding media and the defective staple prevents the stapler apparatus from operating and thus causes a stapling problem, when driving staples, and is mated to the rotating shaft extending to the back side of the output shaft of the direct current motor of the electric drive unit, which is not shown, when manual operations are necessary.

FIG. 2 is an exploded perspective view showing the cartridge holder 200 and staple cartridge 100 that are mounted on the stapler unit 300 in FIG. 1, pulled out.

When pulling from the stapler unit 300, first the cartridge lock lever 600 which abuts the staple cartridge 100 and urgingly supports in the mounting direction is manually pressed downward to release the abutting, then the staple cartridge 100 is pulled from the cartridge holder 200.

Then, the cartridge holder 200 is pulled from the stapler unit 300. Conversely, it is also possible to remove the staple cartridge 100 from the cartridge holder 200 after pulling out the cartridge holder 200 while the staple cartridge 100 is mounted to the cartridge holder 200.

Note that the reverse procedures are acceptable when mounting the staple cartridge 100 and cartridge holder 200 to the stapler unit 300.

The staple cartridge 100 is composed of a semi-transparent plastic case and comprises the storage unit 102 that stores the staple band material 01 into which sheets of a plurality of straight staples linked into a band are wrapped into a roll, and the pull-out guide 103 for pulling out the staple band material 101.

The pull-out guide 103 is mounted to the cartridge holder 200 and is equipped with the opening 104 the guide surface on the leading top side being widely cut away to abut the staple feed means 202 on the cartridge holder 200, the back-feed stopper pawl 105 to arrest so that the staple band material 101 pulled out from the storage unit 102 does not return back into the storage unit 102, and the leading edge stopper 106 that restricts the leading edge of the staple band material 01 that has been pulled out and that positions the leading edge thereof at the binding position while mounted to the stapler unit 300.

Also, it comprises the feed pawl advancing protrusion 107 that protrudes into the guide surface on the top-side of the leading edge formed on the opening 104 on the pull-out guide 103 and advances the staple feed means 202 when mounting to the cartridge holder 200 to press the leading edge of staples in the staple band material 101 to the edge stopper 106.

Furthermore, to both sides of the staple cartridge 100 are equipped the guide protrusion 108 guided when mounting to the cartridge holder 200 and the stopper pawl 109 stopped when mounting to the cartridge holder cartridge holder 200.

Though not shown in the figures, it is possible to bend open the bottom portion the staple cartridge 100 from an appropriate position on the back-feed stopper pawl 105 and the edge stopper 106 to the storage unit 102. By opening, the back-feed stopper pawl 105 is released from stopping the staple band material 101 thereby making it possible to discard all remaining staples when discarding.

The cartridge holder 200 is composed of the holder unit 201, the staple feed means 202, the magnet 203, the guide plate 204 comprising a non-magnetic body, the opening 205, the guide 206, the abutting hole 207 and the auxiliary table 208.

The holder unit 201 is formed of a plastic material to cover the front half of the staple cartridge 100.

The staple feed means 202 is rockingly supported on the holder unit 201 and is constantly urged to the staple pull-out direction by a leaf spring, which is not shown in the figures. It is interlocked to the nipping action of the binding means by the anvil unit 350 and charged. It comprises a feed pawl for pressing the staple sheet surface of the staple band material 101 with the recovery action caused by the release of the charge to advance the staple band material 101.

The magnet 203 and the guide plate 204 faces the staple to be driven at the binding position when mounted to the stapler unit 300 and the magnetic attraction of the magnet attracts mis-driven staples to discharge them outside from the stapler unit 300.

The opening 205 is for setting the leading edge of the stopper 106 on the staple cartridge 100 and the leading edge of the staple to protrude and be set at the binding position.

The guide 206 is for guiding the guide protrusion 108 on the staple cartridge 100 and is composed of a cutout groove and a bottom surface.

The abutting hole 207 abuts the stopper pawl 108 on the staple cartridge 100 and it is one of the supplementary stopping means on the staple cartridge 100 until the staple cartridge 100 is locked by the cartridge lock lever 600.

The supplementary table 208 acts as the loading table where the binding media is loaded along with the table 331 on the staple head unit 330, as shown in FIG. 1, when mounted to the stapler unit 300.

FIG. 3 to FIG. 6 explains the process to charge the staple feeding means 202 by the feeding charge means 355 on the anvil unit 350 in the process for the anvil unit 350 to nip the binding media and to advance staples by the binding action that advances the stable band 101 by releasing that charge.

Figure 3:
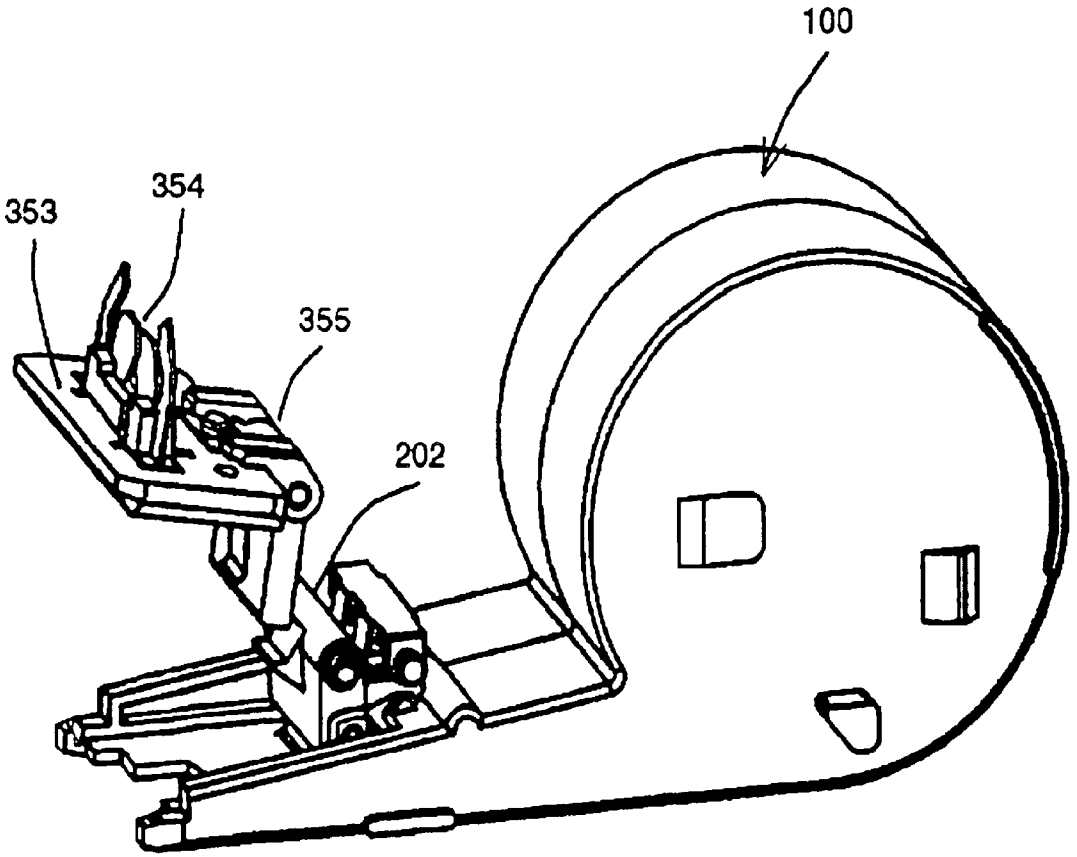
FIG. 3 is a partially expanded status view to explain the relationship between the staple feeding means and the feed pawl charging means according to the invention.

FIG. 3 shows the portion relating to the staple advance in the state shown in FIG. 1, with the anvil unit 353, clincher 354, feed pawl charging means 355, staple feeding means 202 and staple cartridge 100 pulled out.

Figure 4:
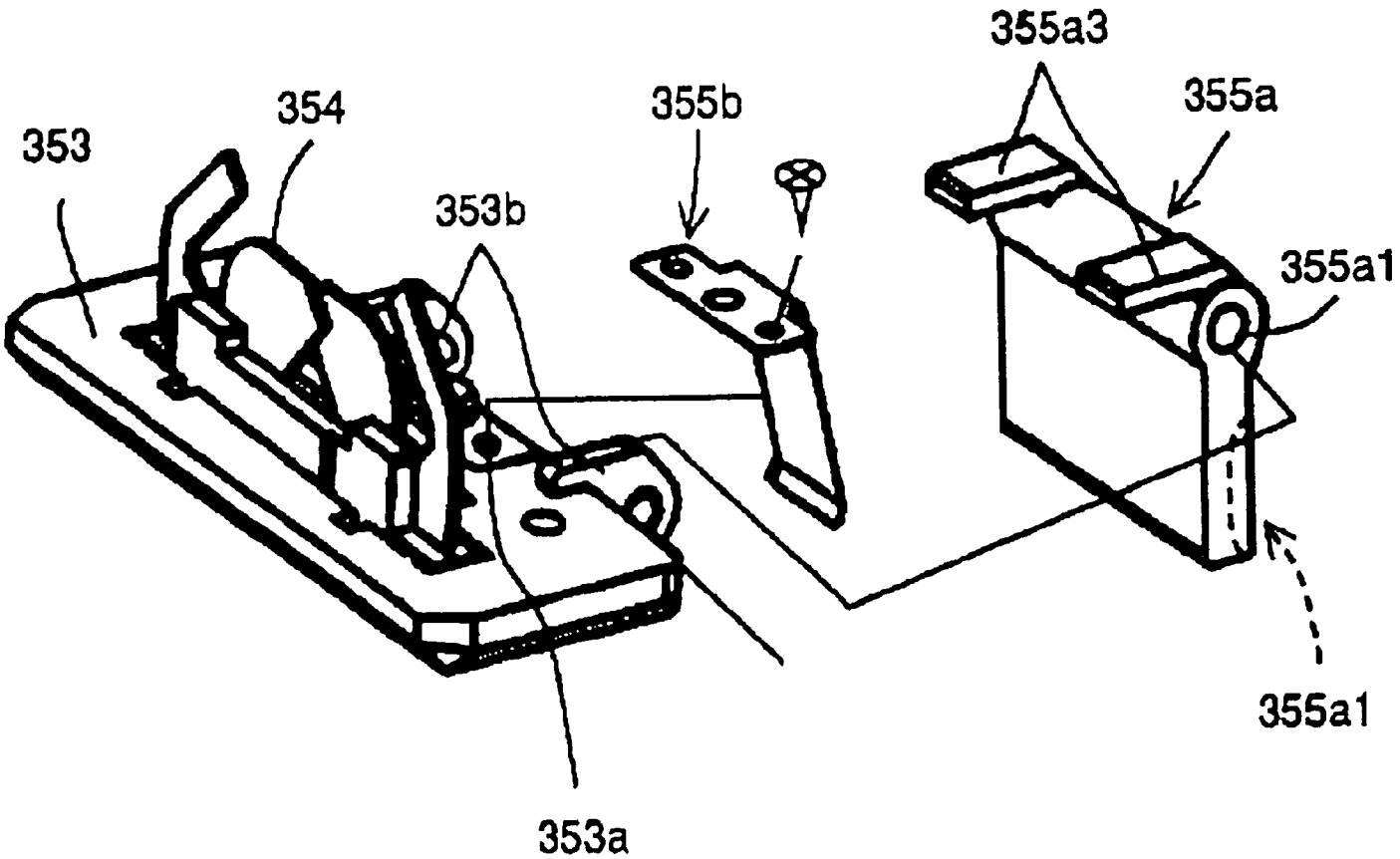
FIG. 4 is a partially expanded status view to explain the feed pawl charging means according to the invention.

FIG. 4 shows particularly the feed charging means 355 of FIG. 3 separated from the anvil head 353. Firstly, after mounting the leaf spring **355*b* to the mounting screw portion 353*a* on the anvil head 353, the feeding pawl charge lever 355 is swingingly supported on the mounting bearing 353*b* on the anvil head 353**.

Figure 5:
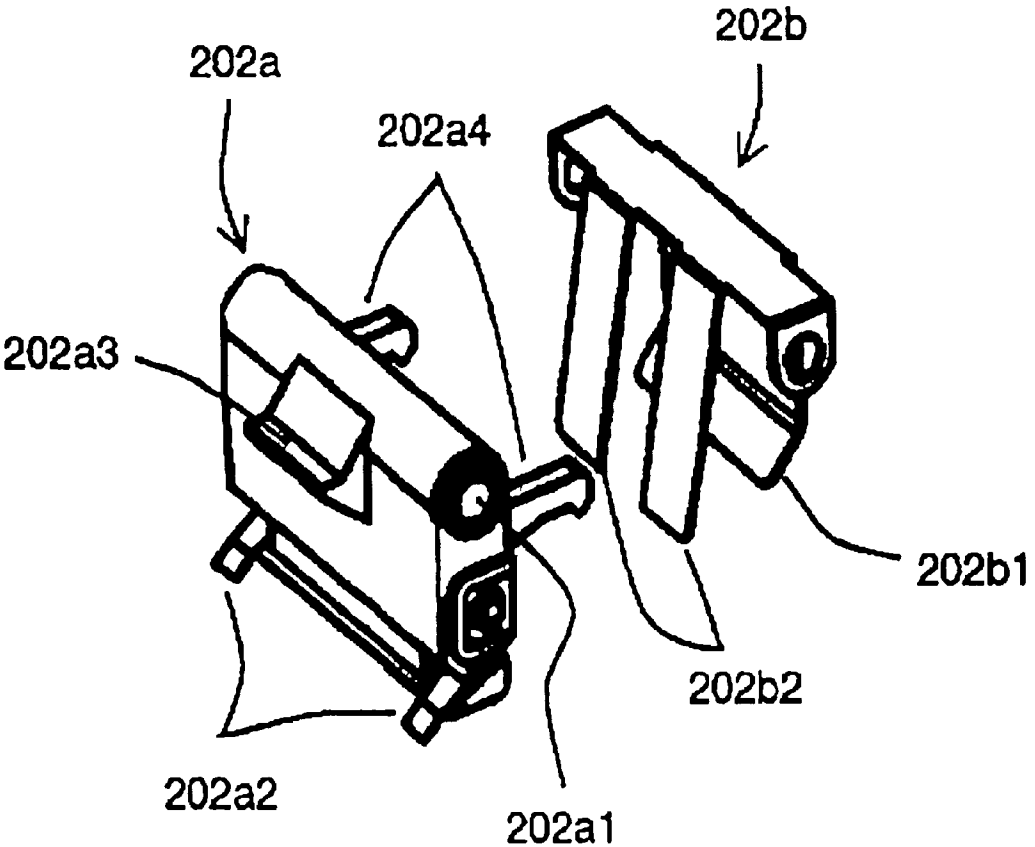
FIG. 5 is a partially expanded status view to explain the staple feeding means according to the invention.

Note that the feed pawl charge lever **355*a* abuts the swinging shaft hole 355*a*1 supported by the mounting bearing 353 on the anvil head 353 and the abutting arm 202*a*3 on the staple feeding means 202 shown in FIG. 5. The staple feeding means 202 swings in the counterclockwise direction around the shaft 202*a*1, is charged. The feed pawl charge release step surface 355*a*2** is formed to release that charge with the subsequent action.

FIG. 5 shows a perspective view of a disassembled staple feeding means 202, composed of the feed pawl member **202*a* and the feed pawl spring 202*b***.

This feed pawl member **202*a* as described with FIG. 2, comprises the shaft 202*a*1 swingingly supported on the cartridge holder 200, the feed pawl 202*a* that touches the surface of the staple sheet on the stable band 101, the abutting arm 202*a*3 abut by the feeding pawl charge lever 355, and the cartridge advancing arm 202*a*4 to urgingly charge by the staple cartridge 100 when mounting the staple cartridge 100 to the cartridge holder 200**.

Also, the feed pawl spring 202*b* is swingingly mounted to the cartridge holder 200 in the same way as the feed pawl member 202*a* and discharges the urging force swingingly in the charging direction of the feed pawl member 202*a* when pulling the staple cartridge 100 from the cartridge holder 200.

Actually, the feed pawl spring 202*b* is formed by the leaf spring into a U-shape, and is composed of the cartridge pressing member 202*b*1 pressed by the staple cartridge 100 extended on both sides thereof, and the feed pawl urging member 202*b*2 that urges the feed pawl member 202*a* by the elastic deformation by the pressing of the cartridge pressing member 202*b*1.

Figure 6:
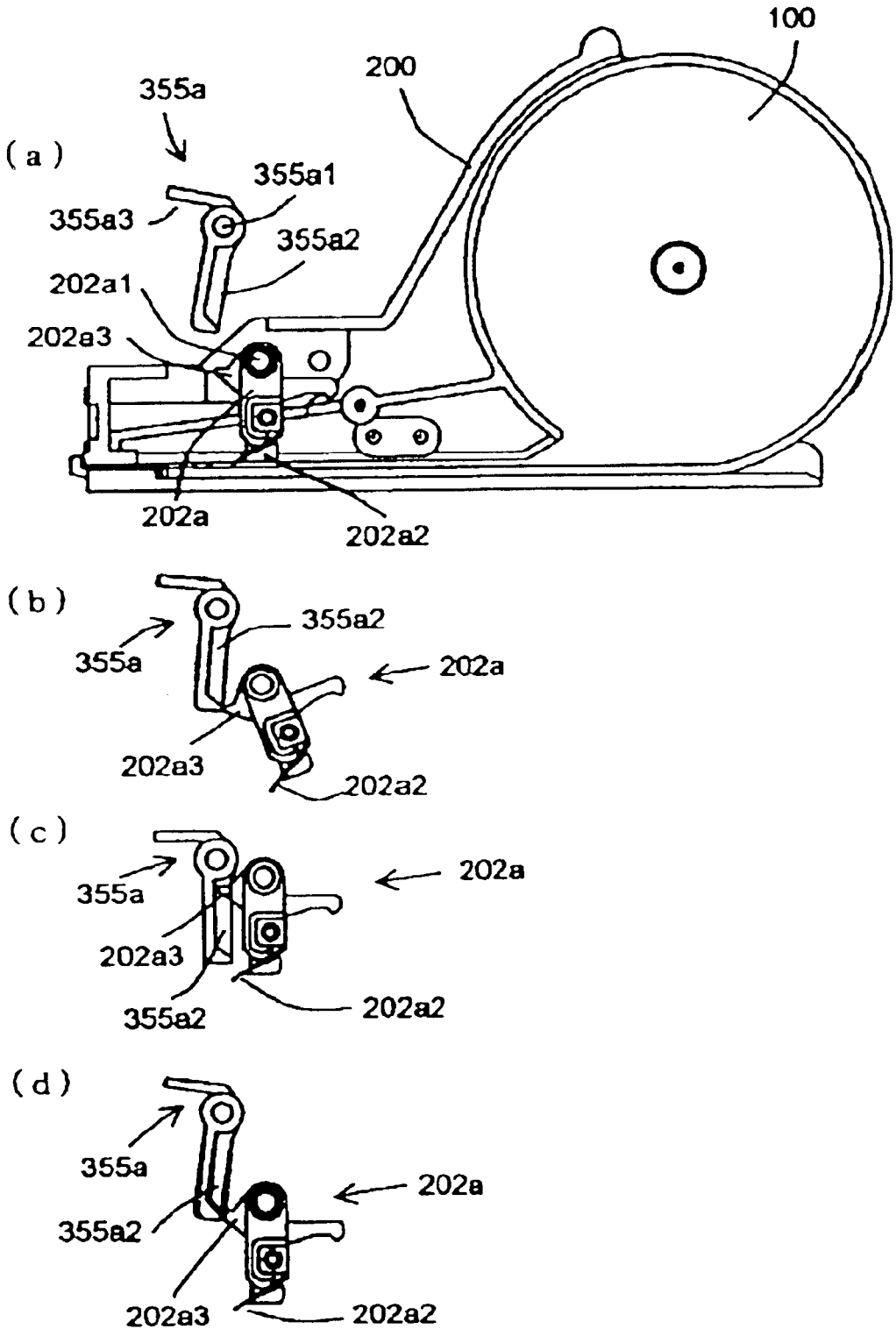
FIG. 6 is a partially expanded status view to explain the relationship of the series of operations between the staple feeding means and the feed pawl charging means according to the invention.

FIG. 6 explains the actuating state of the feeding pawl charge lever 355*a* and the feed pawl member 202*a* in the advancing of the stable band 101 by the staple feeding means 202.

First, FIG. 6(*a*) shows the idling state that can execute the stapling action shown in FIG. 1 and FIG. 3.

FIG. 6(*b*) shows at the timing that avoids the former 333 explained in FIG. 1 touching the leading staple and the driver 332 driving the staple into the binding media, the feed pawl charge lever 355*a* abutting the abutting arm 202*a*3 on the feed pawl member 202*a* and the feed pawl member 202*a* swung in the counterclockwise direction and charged immediately after touching the staple.

Note that staples are formed to a U-shape by the former 333 and if adhering to the next staple, there will be no problem of the staple band 100 returning back, even if the feed pawl charge lever 355*a* is charged and retracted.

However, in FIG. 6(*c*), when the driver 332 drives the staple into the binding media, the charge is released to move the stable band 100 by the feeding force of the feed pawl member 202*a* so that when following from the former 333, the staple is positioned securely at the driving position so that the driver 332 can press without hitting a shoulder of the crown.

FIG. 6(*d*) shows pressing force of the feed pawl urging portion 202*b*2 explained in FIG. 5 overpowering the pressing force of the leaf spring 355*b* explained in FIG. 4 to retract the feeding pawl charge lever 355*a* in the clockwise direction by the abutting arm 202*a*3 on the feed pawl member 202*a*, so that the feeding pawl charge lever 355*a* does not charge the feed pawl member 202*a* again when recovering from the binding media after the anvil unit 350 completes the stapling process.

Figure 7:
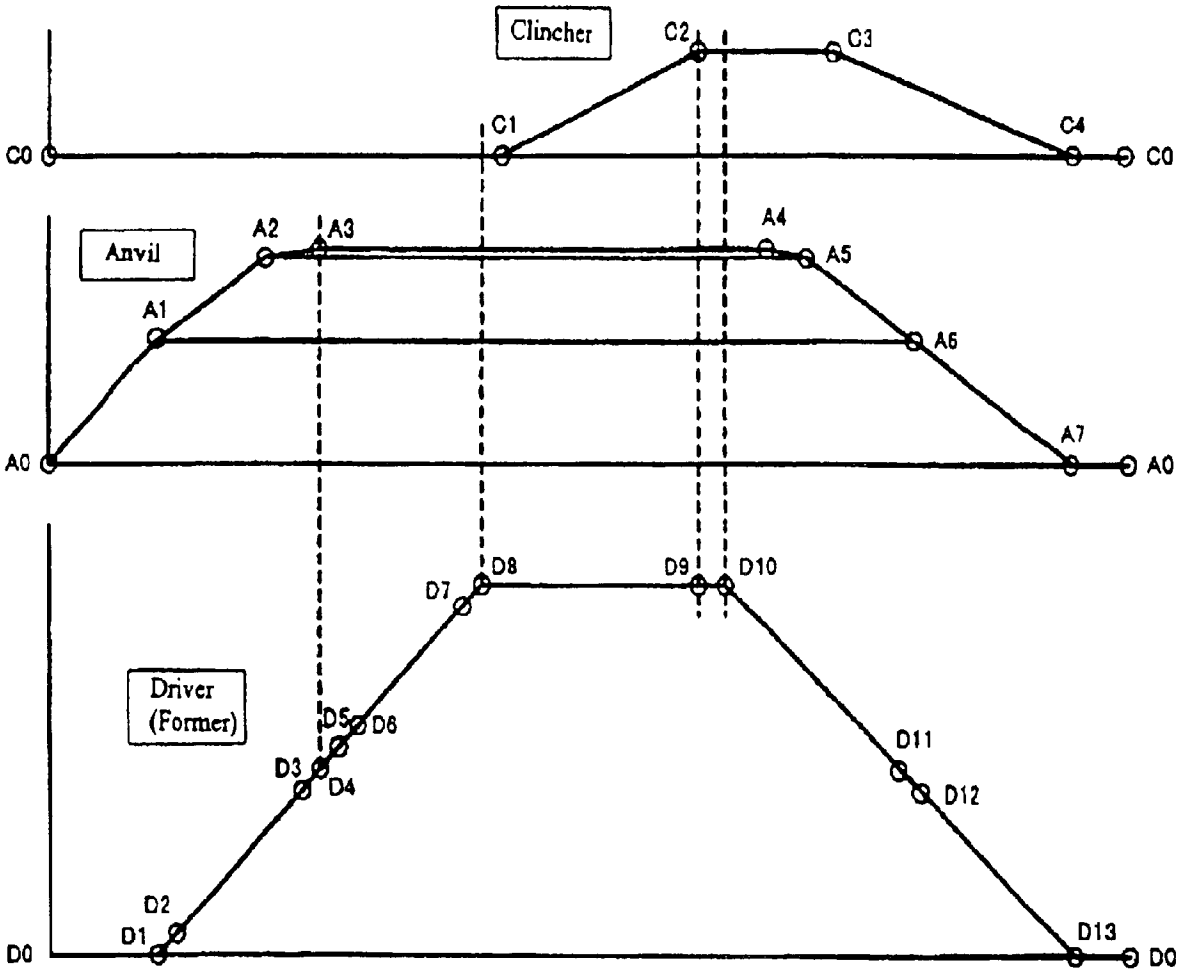
FIG. 7 is a timing chart of the operations of the stapler apparatus according to the embodiment of the instant invention.

FIG. 7 is a timing charge to illustrate the operation of each of the driver, former, anvil and clincher units' processes. The horizontal axis indicates the angle of rotation of the drive cam that drives each unit and the vertical axis shows the amount of displacement of the levers for each unit. The following generally describes the series of actions according to FIG. 1.

Initially, along with the setting to the stapling position of the binding media a staple execution instruction signal is output to the stapler apparatus from an outside source.

The instruction signal starts the rotation of the direct current motor in the electric drive unit, which is not shown in the drawings, first pushing the actuating lever 340 in the downward direction by the anvil drive cam, which is not shown in the drawings, resisting the anvil spring 380.

Following the displacement of the actuating lever 340, the anvil unit 350 moves downward to start nipping the binding media.

Note that interlocked to the nipping of the anvil unit 350, the clincher unit 360 interlocked by the interlock lever 370 and the clincher spring 400 follows the anvil unit 350.

In describing the operation of the anvil unit 360, beginning from the idling position A0, rocking stops at a nipped position according to the thickness (the number of sheets) of the binding media set at the binding position, between the position A1 where, for example, 100 pages of binding media are nipped to the position A2 where 0 pages are nipped of binding media.

After nipping the binding media by the anvil unit 360, only the actuating lever 340 continues displacement resisting the paper thickness absorbing springs 390. The anvil unit 360 maintains a displaced state to the position equivalent to the position A3 by applying an over-stroke to the position A2 to enable the secure nipping even if there are 0 pages of binding media, in consideration of variations in parts and their assembly, to complete the nipping operation of the binding media using the anvil unit 360.

Before operating to the position A3 to complete the nipping operation of the binding media using the anvil unit 360, the driver drive cam CA40, shown in FIG. 4 displaces the driver 332, which is not shown in the drawing, upward, and the former 333 following this displacement is pressed upward.

The driver 332 begins moving from the position D1 when the clincher unit 360 is beyond the position A1, at position D2, the former 333 presses the staple drawing to the driving position and starts forming the staple into a U-shape. In the continuing stroke, by pushing both leading edges of bent staples formed into that shape against the sides of the bending block 335 to guide it, both leading edges of the staple are secured front, back left and right by the non-magnetic materials of the guide plate 204 walls composed of the former 333, the bending block 335 and the cartridge holder 200.

Then, the leading edges that touch the formed staple of the driver 332 are pressed into the oblique surfaces of the bending block 335. The leading edge portion of the driver 332 touches the formed staple at the position D3 with the bending block 335 retracted from the area of movement of the leading edge of the driver 332. The leading edge of the formed staple pressed by the driver 332 delayed from the position A3 where the anvil 350 nips the binding media reaches the position D4 that touches the surface of the sheet of the binding media to start driving the formed staple into the binding media by the driver 332.

After the driver 332 starts driving the staple, at the same time that the abutting portion that was abutting the former 333 on the driver 332 is released from abutting, by the level protrusion on the sheath 334 at the slightly delayed position D5, the former 333 is released from abutting with the driver 332 at the position D6 just prior to the leading edge of the former 333 touching the surface of the sheets in the binding media and the former 333 stops and the former guides the bend staple driven by the driver 332.

Continuing on, the formed staple is driven by the driver 332, and after the formed staple crown touches the surface of the sheets in the binding media at the position D7, the driver 332 is further driven by the driver drive cam at the position D8, but because the driver 332 cannot press the formed staples in, the driver 332 comprising a leaf spring, itself is elastically deformed the amount of the over-stroke to absorb the difference of the mounting position to securely drive the formed staple.

The clincher unit 360 is rocked by the clincher drive unit 602 pressed downward by the clincher drive cam CA10 shown in FIG. 11 from position C1 immediately after the position D8 where the formed staple is driven by the driver

332, pressing the clincher 354 to complete the clinching operation at the position C2 by bending the leading edges of the staples that have penetrated the binding media.

After the clinching operation is completed, first, the recover operation is started for the driver 332 at the position D11. The former 333 part way is re-interlocked and returned to the position D0 which is equivalent to the initial position passing through the positions of D12 and D13.

The anvil unit 350 recovery operation is started slightly delayed to the recovery operation of the driver 332 and is returned to the position A7 which is equivalent to the initial position passing through the position A6.

Finally, the anvil unit 360 recovery operation is started slightly delayed to the recovery operation of the driver 350 and is returned to the position c4 which is equivalent

What is claimed is:

1. A stapler apparatus equipped with linked staples, the stapler apparatus comprising:

a staple feed member configured for feeding staples to a driving position;

a staple driver operable to drive the staples from the driving position into a stack of sheets; and an anvil unit operable to engage and clamp the stack of sheets to be stapled;

wherein the staple feed member is powered by movement of the anvil unit.

2. The stapler apparatus of claim 1, wherein the staple feed member includes a feed pawl in contact with the linked staples.

3. The stapler apparatus of claim 1, wherein the anvil unit includes an anvil head that engages and clamps the stack of sheets to be stapled, and wherein the anvil head supports a feeding pawl charge lever configured to selectively engage the staple feed member to initiate the feeding of staples by the staple feed member.

4. The stapler apparatus of claim 3, wherein the feeding pawl charge lever is pivotally connected to the anvil head.

5. The stapler apparatus of claim 3, further comprising:

a resilient member operable to urge the staple feed member in a staple feeding direction to feed staples toward the driving position;

wherein a resilient force is created in the resilient member by the engagement of the feeding pawl charge lever with the staple feed member, and the resilient force of the resilient member urges the staple feed member in the staple feeding direction.

6. The stapler apparatus of claim 5, wherein the feeding pawl charge lever includes a stepped surface configured to permit the staple feed member to move in the staple feeding direction after the feeding pawl charge lever has engaged the staple feed member to create the resilient force in the resilient member.

7. The stapler apparatus of claim 5, wherein the staple feed member moves in the staple feeding direction after a staple in the staple driving position is driven by the staple driver.

8. The stapler apparatus of claim 5, wherein the resilient member is a leaf spring.

9. The stapler apparatus of claim 1, wherein the staple feed member is initially actuated by movement of the anvil unit toward a sheet clamping position, prior to movement of the staple driver.

10. The stapler apparatus of claim 9, wherein the staple feed member moves in a staple feed direction to feed a staple to the staple driving position after the movement of the anvil unit toward the sheet clamping position has initially actuated the staple feed member and after the staple driver has driven a staple.

11. The stapler apparatus of claim 1, wherein the staple driver and the anvil unit are arranged on opposite sides of the linked staples, and the staple feed member is disposed on a same side of the linked staples as the anvil unit.

* * * * *